United States Patent [19]

Lathers

[11] Patent Number: 4,879,962

[45] Date of Patent: Nov. 14, 1989

[54] CONVERTIBLE DINETTE/SLEEPER FOR RECREATIONAL BOAT

[75] Inventor: Michael W. Lathers, Metamora, Mich.

[73] Assignee: Outboard Marine Corporation, Waukegan, Ill.

[21] Appl. No.: 216,797

[22] Filed: Jul. 8, 1988

[51] Int. Cl.[4] ..... B63B 29/04

[52] U.S. Cl. ..... 114/188; 114/189; 5/3; 5/4

[58] Field of Search ..... 114/71, 188, 189

[56] References Cited

U.S. PATENT DOCUMENTS

| | | | |
|---|---|---|---|
| 127,604 | 6/1872 | Hoyt . | |
| 135,827 | 2/1873 | Loth . | |
| 1,385,446 | 7/1921 | Gunn | 5/4 |
| 1,583,264 | 5/1926 | Turner . | |
| 1,732,481 | 10/1929 | Miller et al. . | |
| 2,102,980 | 12/1937 | Spanglet | 5/4 |
| 2,497,412 | 2/1950 | Larin | 114/188 |
| 3,636,892 | 1/1972 | Linton | 108/79 |
| 3,738,699 | 6/1973 | Fain | 296/23 |
| 3,866,548 | 2/1975 | Skonieczny | 108/79 |
| 4,616,370 | 10/1986 | Keenan et al. | 5/3 |
| 4,707,871 | 11/1987 | Pocanschi | 5/3 |
| 4,714,043 | 12/1987 | Sheppard | 114/188 |

*Primary Examiner*—Sherman D. Basinger
*Assistant Examiner*—Stephen P. Avila
*Attorney, Agent, or Firm*—Michael, Best & Friedrich

[57] ABSTRACT

A marine vehicle comprising a hull, and a convertible dinette/sleeper apparatus including a base supported by the hull and including a generally horizontal upper surface having therein a recess, a table portion having a generally planar upper surface, and means supporting the table portion for movement between a first position wherein the table portion is located above the recess and the upper surface of the table portion extends generally horizontally and is spaced above the upper surface of the base, and a second position wherein the table portion is located in the recess and the upper surface of the table portion is substantially coplanar with the upper surface of the base.

18 Claims, 2 Drawing Sheets

CONVERTIBLE DINETTE/SLEEPER FOR RECREATIONAL BOAT

BACKGROUND OF THE INVENTION

The invention relates to recreational boats, and, more particularly, to cabin furniture for such boats. Still more particularly, the invention relates to dinette arrangements for recreational boats.

SUMMARY OF THE INVENTION

The invention provides a marine vehicle comprising a hull, and a table apparatus including a base supported by the hull, a table portion having a generally planar upper surface, a first support member extending generally perpendicular to the table portion and having an upper end fixedly secured to the table portion, and a lower end, and a second support member having an upper end connected to the lower end of the first support member for pivotal movement about a first generally horizontal axis, and a lower end connected to the base for pivotal movement about a second axis generally parallel to the first axis, the first and second members being moveable between a first position wherein the first and second support members are end-to-end, wherein the second support member extends upwardly from the second axis, and wherein the first support member extends upwardly from the first axis, and a second position wherein the first and second support members are side-by-side, wherein the second support member extends downwardly from the second axis, and wherein the first support member extends upwardly from the first axis.

In one embodiment, the base includes a pair of seat members having upper surfaces cooperating to define the upper surface of the base, and the seat members are spaced apart to define therebetween the recess.

In one embodiment, the table portion has an end, and the apparatus also includes a table extension portion, and means connecting the extension portion to the table portion for movement between an extended position wherein the extension portion is substantially coplanar with the table portion and extends outwardly from the end of the table portion, and a retracted position wherein the extension portion is located beneath the end of the table portion.

In one embodiment, the apparatus also includes a brace member extending generally perpendicular to the table portion, abutting the first support member and having an upper end fixedly connected to the table portion, and a lower end which extends below the lower end of the first support member and which overlaps the upper end of the second support member when the first and second members are in the first position, and means for releasably securing the lower end of the brace member to the second member when the first and second members are in the first position.

The invention also provides a table apparatus comprising a base, a table portion having a generally planar upper surface, a first support member extending generally perpendicular to the table portion and having an upper end fixedly secured to the table portion, and a lower end, and a second support member having an upper end connected to the lower end of the first support member for pivotal movement about a first generally horizontal axis, and a lower end connected to the base for pivotal movement about a second axis generally parallel to the first axis, the first and second members being moveable between a first position wherein the first and second support members are end-to-end, wherein the second support member extends upwardly from the second axis, and wherein the first support member extends upwardly from the first axis, and a second position wherein the first and second support members are side-by-side, wherein the second support member extends downwardly from the second axis, and wherein the first support member extends upwardly from the first axis.

A principal feature of the invention is the provision of a convertible dinette/sleeper comprising a base including a generally horizontal upper surface having therein a recess, a table portion having a generally planar upper surface, and means supporting the table portion for movement between a first or dining position wherein the table portion is located above the recess and the upper surface of the table portion extends horizontally and is spaced above the upper surface of the base, and a second or sleeping position wherein the table portion is located in the recess and the upper surface of the table portion is coplanar with the upper surface of the base.

Other features and advantages of the invention will become apparent to those skilled in the art upon review of the following detailed description, claims and drawings.

Figure 1:
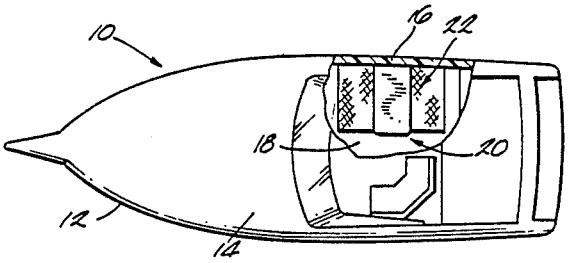
FIG. 1 is a plan view of a recreational boat embodying the invention and comprising a convertible dinette/-sleeper.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A recreational boat or marine vehicle 10 embodying the invention is illustrated in the drawings. The boat 10 comprises a hull 12, and a top deck member 14, a cabin wall 16, and a cabin floor 18 defining a cabin 20.

The boat 10 also comprises a convertible dinette/-sleeper apparatus 22 including a base 24 supported by the floor 18. The base 24 includes a generally horizontal upper surface 26 having therein a recess 28. More particularly, in the preferred embodiment, the base 24 includes a pair of seat members 30 having upper surfaces 32 cooperating to define the upper surface 26 of the base 24, and the seat members 30 are spaced apart to define therebetween the recess 28. It should be understood that while the seat members 30 are shown as part of a unitary base, the seat members 30 could be entirely separate.

Figure 4:
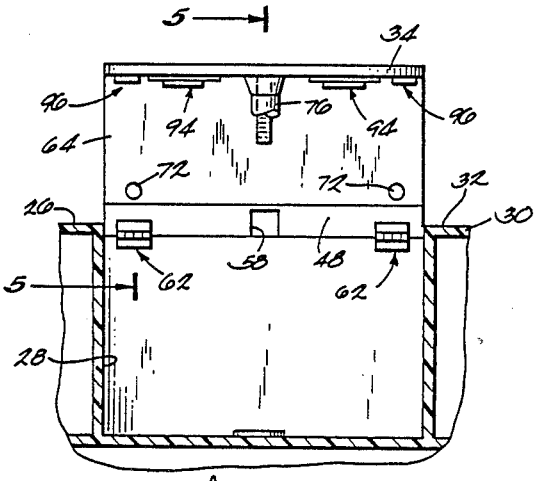
FIG. 4 is a view taken along line 4—4 in FIG. 3.
Figure 7:
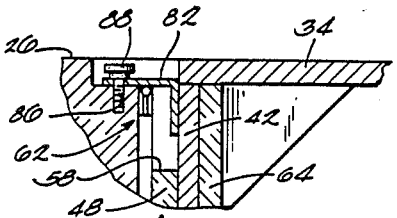
FIG. 7 is a view similar to FIG. 5 but showing the table portion in the sleeping position.
Figure 2:
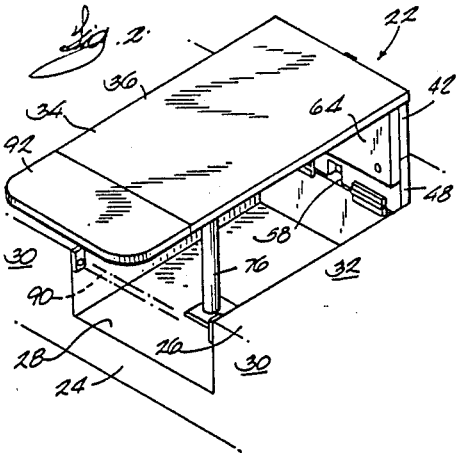
FIG. 2 is a perspective view of the dinette/sleeper.
Figure 6:
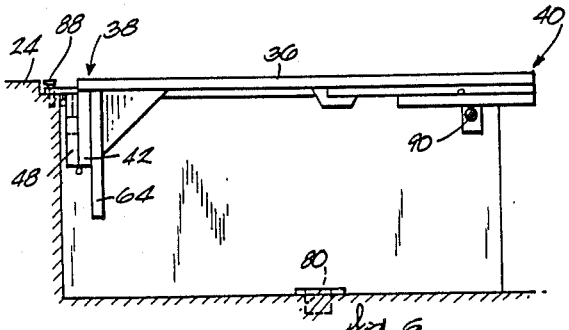
FIG. 6 is a side elevational view of the dinette/-sleeper with the table portion in the sleeping position.

The apparatus 22 also includes a table portion 34 having a generally planar upper surface 36 and inner and outer ends 38 and 40, respectively. The apparatus 22 further includes means supporting the table portion 34 for movement between a first or dining position (FIGS. 2–5) wherein the table portion 34 is located above the recess 28 and the upper surface 36 of the table portion 34 extends generally horizontally and is spaced above the upper surface 26 of the base 24, and a second or sleeping position (FIGS. 6 and 7) wherein the table portion 34 is located in the recess 28 and the upper surface 36 of the table portion 34 is substantially coplanar with the upper surface 26 of the base 24. While various suitable supporting means can be employed, in the preferred embodiment, the supporting means includes a first support member or board 42 extending generally perpendicular to the table portion 34. The first support member 42 has a width (the dimension from left to right in FIG. 4) substantially equal to the width of the table portion 34, an upper end 44 fixedly secured to the underside of the table portion 34 at the inner end 38 of the table portion 34, and a lower end 46. The supporting means also includes a second support member or board 48 having a width substantially equal to the width of the table portion 34, an upper end 50 connected to the lower end 46 of the first support member 42 for pivotal movement about a first generally horizontal axis 52, and a lower end 54 connected to the base 24 for pivotal movement about a second axis 56 generally parallel to the first axis 52. As shown in FIGS. 2, 4 and 7, the lower end 54 of the second support member 48 has therein a cutout or notch 58, the reason for which is explained hereinafter.

Preferably, the first and second support members 42 and 48 are substantially identical in size. Accordingly, the first support member 42 has a first length (the vertical dimension in FIG. 5) between the upper and lower ends of the first support member 42, and the second support member 48 has a second length between the upper and lower ends of the second support member 48, the second length being substantially equal to the first length. While any suitable means can be employed for pivotally connecting the second support member 48 to the first support member 42 and to the base 24, in the illustrated construction, the upper end 50 of the second support member 48 is pivotally connected to the first support member 42 by a hinge apparatus 60, and the lower end 54 of the second support member 48 is pivotally connected to the base 24 by a pair of hinge apparatus 62.

Figure 8:
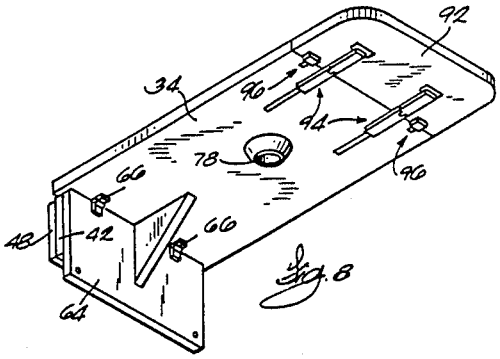
FIG. 8 is a perspective view of the underside of the table portion.
Figure 3:
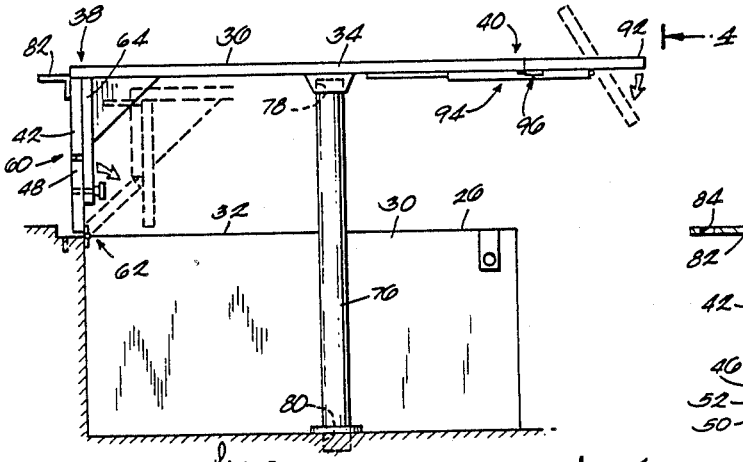
FIG. 3 is a side elevational view of the dinette/-sleeper with the table portion in the dining position.
Figure 5:
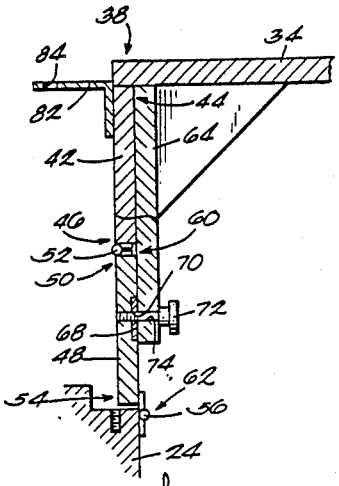
FIG. 5 is a view taken along line 5—5 in FIG. 4.

The supporting means also includes a brace member or board 64 extending generally perpendicular to the table portion 34 and abutting the first support member 42. The brace member 64 has an upper end fixedly connected to the underside of the table portion 34, and a lower end which extends below the lower end of the first support member 42 and which overlaps the upper end of the second support member 48 (see FIGS. 3 and 5) when the first and second support members 42 and 48 are in the first position. The brace member 64 is located outwardly of the first support member 42 or toward the outer end 40 of the table portion 34. Along with other suitable means (not shown) for connecting the upper end of the brace member 64 to the underside of the table portion 34, a pair of braces 66 (FIG. 8) help to maintain the perpendicular relation between the base member 64 and the table portion 34. While in the preferred embodiment the table portion 34, the first support member 42 and the brace member 64 are separate pieces, it should be understood that they could be a unitary piece.

The supporting means further includes means for releasably locking the first and second members 42 and 48 in the first position. While various suitable means can be employed, in the preferred embodiment, such means includes means for releasably securing the lower end of the brace member 64 to the second member 48 when the first and second members 42 and 48 are in the first position. While various suitable securing means can be used, in the illustrated construction, this means includes a pair of plates 68 (see FIG. 5—only one plate 68 is shown) which are located on the second support member 48 and which have therein respective threaded bores 70, and a pair of locking bolts 72 which can be extended through bores 74 in the brace member 64 and threaded into the bores 70 when the first and second members 42 and 48 are in the first position. The locking bolts 72 secure the lower end of the brace member 64 against the upper end of the second support member 48 so that the first and second support members 42 and 48 cannot pivot relative to each other and thereby move from the first position.

The supporting means also includes (see FIG. 3) a removable leg 76 extending downwardly from the table portion 34 and between the base 24 and the table portion 34 for supporting the table portion 34 in the first position. More particularly, the underside of the table portion 34 has therein (see FIG. 8) a socket 78, the base 24 has therein a socket 80, and the upper and lower ends of the leg 76 are removably secured in the sockets 78 and 80, respectively.

The supporting means further includes second means for releasably locking the first and second support members 42 and 48 in the second or sleeping position. While various suitable locking means can be used, in the illustrated construction, such means includes means for releasably securing the table portion 34 to the base 24 when the first and second support members 42 and 48 are in the second position. While various suitable securing means can be employed, in the preferred embodiment, such means includes (see FIGS. 5–7) an L-shaped bracket 82 including a vertical leg fixedly secured to the back of the first support member 42, and a horizontal leg extending rearwardly or inwardly from the inner end 38 of the table portion 34 and having therein a bore 84. The securing means also includes a bore 86 (FIG. 7) that is located in the base 24 and that is aligned with the bore 84 in the bracket 82 when the first and second support members 42 and 48 are in the second position, and a locking bolt 88 which can be extended through the bore 84 in the bracket 82 and threaded into the bore 86 in the base 24 to secure the bracket 82 (and thus the table portion 34) to the base 24 when the first and second support members are in the second position. As shown in FIG. 7, the vertical leg of the bracket 82 is located inside the notch 58 in the second support member 48 when the first and second support members 42 an 48 are in the second position.

The supporting means further includes a supporting member or tube 90 (shown in dotted lines in FIG. 2 and in cross-section in FIG. 6) removably connected to the base 24 and extending across the recess 28 for supporting the table portion 34 in the second position. The tube 90 can be secured to the base 24 by any suitable means. The tube 90 is removed when the table portion 34 is in the first position.

The apparatus 22 also includes a table extension portion 92, and means connecting the extension portion 92 to the outer end 40 of the table portion 34 for movement between an extended position (FIGS. 2, 3 and 8) wherein the extension portion 92 is substantially coplanar with the table portion 34 and extends outwardly from the outer end 40 of the table portion 34, and a retracted position (FIG. 6) wherein the extension portion 92 is located beneath the outer end 40 of the table portion 34. While various suitable connecting means can be employed, in the preferred embodiment, such means includes a pair of conventional slide hinges 94. Selectively releasable clips 96 are provided for releasably securing the extension portion 92 in its extended and retracted positions. The extension portion 92 is moved from its extended position to its retracted position by releasing the clips 96, rotating the extension portion 92 180° about the ends of the slide hinges 94 (as shown in dotted lines in FIG. 3), and sliding the extension portion 92 beneath the outer end 40 of the table portion 34 (to the position shown in FIG. 6).

When the table portion 34 is in the dining position, persons can sit on the seat members 30 with their legs extending beneath the table portion 34 and with their feet in the recess 28. When the table portion 34 is in the sleeping position, the upper surface 36 of the table portion 34 and the upper surface 26 of the base 24 provide a flat sleeping surface. Cushions can be placed over the seat members 30 and additional cushions (such as seat back cushions) can be placed over the table portion 34 when it is in the sleeping position.

Various features of the invention are set forth in the following claims.

I claim:

1. A marine vehicle comprising a hull, and a convertible dinette/sleeper apparatus including a base supported by said hull and including a generally horizontal upper surface having therein a recess, a table portion having a generally planar upper surface, and means supporting said table portion for movement between a first position wherein said table portion is located above said recess and said upper surface of said table portion extends generally horizontally and is spaced above said upper surface of said base, and a second position wherein said table portion is located in said recess and said upper surface of said table portion is substantially coplanar with said upper surface of said base, said supporting means including a first support member extending generally perpendicularly to said table portion and having an upper end fixedly secured to said table portion, and a lower end, and a second support member having an upper end connected to said lower end of said first support member for pivotal movement about a first generally horizontal axis, and a lower end connected to said base for pivotal movement about a second axis generally parallel to said first axis, said first and second members being moveable between a first position wherein said first and second support members are end-to-end, wherein said second support member extends upwardly from said second axis, and wherein said first support member extends upwardly from said first axis, and a second position wherein said first and second support members are side-by-side, wherein said second support member extends downwardly from said second axis, and wherein said first support member extends upwardly from said first axis.

2. A marine vehicle as set forth in claim 1 wherein said base includes a pair of seat members having upper surfaces cooperating to define said upper surface of said base, and said seat members being spaced apart to define therebetween said recess.

3. A marine vehicle as set forth in claim 1 wherein said supporting means further includes first means for releasably locking said first and second members in said first position, and second means for releasably locking said first and second members in said second position.

4. A marine vehicle as set forth in claim 1 wherein said first support member has a first length between said upper and lower ends of said first support member, and wherein said second support member has a second length between said upper and lower ends of said second support member, said second length being substantially equal to said first length.

5. A marine vehicle as set forth in claim 1 wherein said supporting means also includes a brace member extending generally perpendicularly to said table portion, abutting said first support member and having an upper end fixedly connected to said table portion, and a lower end which extends below said lower end of said first support member and which overlaps said upper end of said second support member when said first and second members are in said first position, and means for releasably securing said lower end of said brace member to said second member when said first and second members are in said first position.

6. A marine vehicle as set forth in claim 1 wherein said supporting means further includes means for releasably securing said table portion to said base when said first and second members are in said second position.

7. A marine vehicle as set forth in claim 1 wherein said table portion has an end, and wherein said apparatus also includes a table extension portion, and means connecting said extension portion to said table portion for movement between an extended position wherein said extension portion is substantially coplanar with said table portion and extends outwardly from said end of said table portion, and a retracted position wherein said extension portion is located beneath said end of said table portion.

8. A marine vehicle as set forth in claim 1 wherein said supporting means includes a removable leg extending downwardly from said table portion for supporting said table portion in said first position.

9. A marine vehicle as set forth in claim 1 wherein said supporting means includes a supporting member removably connected to said base and extending across said recess for supporting said table portion in said second position.

10. A marine vehicle comprising a hull, and a table apparatus including a base supported by said hull, a table portion having a generally planar upper surface, a first support member extending generally perpendicularly to said table portion and having an upper end fixedly secured to said table portion, and a lower end, and a second support member having an upper end connected to said lower end of said first support member for pivotal movement about a first generally horizontal axis, and a lower end connected to said base for pivotal movement about a second axis generally parallel to said first axis, said first and second members being moveable between a first position wherein said first and second support members are end-to-end, wherein said second support member extends upwardly from said second axis, and wherein said first support member extends upwardly from said first axis, and a second position wherein said first and second support members are side-by-side, wherein said second support member extends downwardly from said second axis, and wherein said first support member extends upwardly from said first axis.

11. A marine vehicle as set forth in claim 10 wherein said apparatus further includes first means for releasably locking said first and second members in said first position, and second means for releasably locking said first and second members in said second position.

12. A marine vehicle as set forth in claim 10 wherein said first support member has a first length between said upper and lower ends of said first support member, and wherein said second support member has a second length between said upper and lower ends of said second support member, said second length being substantially equal to said first length.

13. A marine vehicle as set forth in claim 10 wherein said apparatus also includes a brace member extending generally perpendicularly to said table portion, abutting said first support member and having an upper end fixedly connected to said table portion, and a lower end which extends below said lower end of said first support member and which overlaps said upper end of said second support member when said first and second members are in said first position, and means for releasably securing said lower end of said brace member to said second member when said first and second members are in said first position.

14. A marine vehicle as set forth in claim 10 wherein said apparatus further includes means for releasably securing said table portion to said base when said first and second members are in said second position.

15. A convertible dinette/sleeper apparatus comprising a base including a generally horizontal upper surface having therein a recess, a table portion having a generally planar upper surface, and means supporting said table portion for movement between a first position wherein said table portion is located above said recess and said upper surface of said table portion extends generally horizontally and is spaced above said upper surface of said base, and a second position wherein said table portion is located in said recess and said upper surface of said table portion is substantially coplanar with said upper surface of said base, said supporting means including a first support member extending generally perpendicularly to said table portion and having an upper end fixedly secured to said table portion, and a lower end, and a second support member having an upper end connected to said lower end of said first support member for pivotal movement about a first generally horizontal axis, and a lower end connected to said base for pivotal movement about a second axis generally parallel to said first axis, said first and second members being moveable between a first position wherein said first and second support members are end-to-end, wherein said second support member extends upwardly from said second axis, and wherein said first support member extends upwardly from said first axis, and a second position wherein said first and second support members are side-by-side, wherein said second support member extends downwardly from said second axis, and wherein said first support member extends upwardly from said first axis.

16. An apparatus as set forth in claim 15 wherein said base includes a pair of seat members having upper surfaces cooperating to define said upper surface of said base, and said seat members being spaced apart to define therebetween said recess.

17. An apparatus as set forth in claim 15 wherein said supporting means also includes a brace member extending generally perpendicularly to said table portion, abutting said first support member and having an upper end fixedly connected to said table portion, and a lower end which extends below said lower end of said first support member and which overlaps said upper end of said second support member when said first and second members are in said first position, and means for releasably securing said lower end of said brace member to said second member when said first and second members are in said first position.

18. A table apparatus comprising a base, a table portion having a generally planar upper surface, a first support member extending generally perpendicularly to said table portion and having an upper end fixedly secured to said table portion, and a lower end, and a second support member having an upper end connected to said lower end of said first support member for pivotal movement about a first generally horizontal axis, and a lower end connected to said base for pivotal movement about a second axis generally parallel to said first axis, said first and second members being movable between a first position wherein said first and second support members are end-to-end, wherein said second support member extends upwardly from said second axis, and wherein said first support member extends upwardly from said first axis, and a second position wherein said first and second support members are side-by-side, wherein said second support member extends downwardly from said second axis, and wherein said first support member extends upwardly from said first axis.

* * * * *